US007708289B2

(12) United States Patent
Jaime, Sr.

(10) Patent No.: US 7,708,289 B2
(45) Date of Patent: May 4, 2010

(54) REMOVABLE TUBULAR VARIABLE LIGHTING SYSTEM FOR A SKATEBOARD

(76) Inventor: Richard A. Jaime, Sr., 1704 Grouse Run Cir., Roseville, CA (US) 95747

( * ) Notice: Subject to any disclaimer, the term of this patent is extended or adjusted under 35 U.S.C. 154(b) by 11 days.

(21) Appl. No.: 11/899,637

(22) Filed: Sep. 7, 2007

(65) Prior Publication Data

US 2009/0067187 A1 Mar. 12, 2009

(51) Int. Cl.
*A63C 17/01* (2006.01)
*A63C 17/26* (2006.01)
*B62M 1/00* (2006.01)

(52) U.S. Cl. ..... 280/11.203; 280/841; 280/14.21; 280/87.01; 280/87.041; 280/87.042

(58) Field of Classification Search ..... 280/11.203, 280/11.12, 11.15, 841, 7.13, 7.1, 14.21, 87.01, 280/87.041, 87.042, 845
See application file for complete search history.

(56) References Cited

U.S. PATENT DOCUMENTS 4,991,066 A * 2/1991 McCowan ..... 362/464
4,997,196 A * 3/1991 Wood ..... 280/87.042
5,132,883 A * 7/1992 La Lumandier ..... 362/466
5,292,141 A * 3/1994 Ekedal et al. ..... 280/87.042
6,431,733 B2 * 8/2002 Seifert et al. ..... 362/459
6,621,419 B2 * 9/2003 Chiu ..... 340/815.42
6,646,547 B2 * 11/2003 Chiu ..... 340/321
6,802,636 B1 * 10/2004 Bailey, Jr. ..... 362/555
7,046,160 B2 * 5/2006 Pederson et al. ..... 340/815.45
7,048,284 B1 * 5/2006 Seifert ..... 280/79.11
7,232,243 B1 * 6/2007 Nassif ..... 362/459
2004/0257831 A1 * 12/2004 Liao ..... 362/565
2005/0029767 A1 * 2/2005 Chang ..... 280/87.042

* cited by examiner

*Primary Examiner*—Paul N Dickson
*Assistant Examiner*—John R Olszewski
(74) *Attorney, Agent, or Firm*—Donald W. Meeker

(57) ABSTRACT

A multiple tube, multiple lights effects neon or fluorescent lighting system for a skateboard produces a variety of controlled light effects and combinations. A pair of high strength colored protective transparent elongated casings house the light tubes. The casings are removably attached in a highly visible position on the side edges of a skateboard or under the skateboard adjacent to the side edges. The casings are secured by industrial strength mating hook and loop fasteners.

9 Claims, 3 Drawing Sheets

REMOVABLE TUBULAR VARIABLE LIGHTING SYSTEM FOR A SKATEBOARD

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to illumination devices for skateboards and particularly to a colored tubular fluorescent light which is removably mounted on the bottom or sides of a skateboard or other vehicle; the fluorescent tube light is powered by a battery and has a power control button which allows the user to turn the light on or off and to choose from various lighting displays, such as flashing light, steady light, or to have the light travel back and forth along the length of the light bulb.

2. Description of Related Art Including Information Disclosed Under 37 CFR 1.97 and 1.98

Illuminated skateboards are well known in prior art, most use LED, fiber optic, or neon lighting systems built into the skateboard truck or permanently mounted on the sides or bottom of the skateboard deck.

Due to the excessive activity, constant banging, dropping, and abuse to skateboards in their use it is necessary to provide a high strength secured and protected light source removably attachable to a skateboard with a variety of lighting options to enhance the visual effects of the lighted skateboard in action. Prior art devices do not adequately meet these needs.

U.S. Patent Application #20070047216, published Mar. 1, 2007 by Piazzolla, is for a glow stick holder which mounts to an article such as, but not limited to, a skateboard, an inline roller skate, a snow ski or the like. In one embodiment, the device has an open ended transparent tube for interlocking receipt of the glow stick therein. In another embodiment, a semi-cylindrical clip is sized, structured and disposed before snap fit grasping receipt of the glow stick. One or more brackets have a collar that surrounds and holds the tube or semi-cylindrical clip, and a mounting flange for attaching the bracket to the article using, for instance, screws, hook and loop fasteners, or an adhesive. Alternatively, the brackets may directly hold the glow stick. In this instance, the collar of the bracket is signed for grasping receipt of the glow stick.

U.S. Patent Application #20050102733, published May 19, 2005 by Holmberg, claims lighted sports equipment comprising a ski pole includes a tip portion, an illuminable shaft portion, and a grip portion. The tip portion has a tip end and a connecting end. The illuminable shaft portion has a first engaging end, a second engaging end that is removably coupled to the connecting end of the tip portion, and an illumination means for illuminating the illuminable shaft portion in response to provision of electrical energy thereto. The grip portion has an end that is removably coupled to the first engaging end of the illuminable shaft portion. The equipment further comprises means for selectively providing electrical energy to the illuminable shaft portion. Also disclosed is lighted sports equipment such as a snowboard, a waterboard, and a skateboard. Neon may also be used for illumination.

Two U.S. Patent Applications, #20010004808 published Jun. 28, 2001 and #20010024364 published Sep. 27, 2001 by Hurwitz, describe safety and sports equipment including a skateboard, as well as apparel and accessories, including one or more wire-like or flat electroluminescent lamps for illumination. The lamps may be powered by battery, solar energy, or any other suitable means of energy. The lamps may further be secured to an object, embedded within a rigid surface, or recessed within a material. The lamps may be either permanently, temporarily, or removably secured to the object that is being illuminated.

U.S. Patent Application #20030231485, published Dec. 18, 2003 by Chien, discloses a tubular electro-luminescent panel(s) light device which offers a desired bending directions with super brightness basing on certain width of panel incorporated proper invertor system. The said panel(s) with much narrow width than tube means to allow the panel(s) can be bent at any direction and angle within the tube means to offer a desired light effect. The said panel(s) can be flat or twisted within the tube means which may have the desired colored, transparency, wall thickness, diameter, shape, length for requirement. The said device may incorporated with non-elastic means, magnetic means, tube holder, sensor means, Integrated circuit to add a lot of desired variety features. Neon may also be used U.S. Patent Application #20060158890, published Jul. 20, 2006 by Freedman, provides a lightweight, shockproof lighting system designed to mount on the underside of a vehicle, providing decorative pattern of light on the ground beneath the vehicle, and providing significant visibility to others using the road. The lighting system is comprised of impact-resistant, waterproof transparent plastic tubes, which house fragile, elongated fluorescent lamps by cushioning them from road shock with springs. These light tubes also include an internal reflector, which directs more of the light towards the road. The lighting system is provided with a wiring arrangement for connection to a source of electrical power, such as a battery pack or wheel generator.

U.S. Patent Application #20050236998, published Oct. 27, 2005 by Mueller, claims light emitting diode based products. Methods and systems are provided for controlled semiconductor-based illumination. In one example, one or more semiconductor-based illumination systems are configured to illuminate an area about the illumination system(s). A user interface facility is employed to instruct one or more of the semiconductor-based illumination systems to produce a desired mixed light output to illuminate the area about the illumination system(s). The LED system may be adapted to a variety of lighting applications, either as a replacement for conventional light bulbs, including incandescent light bulbs, halogen light bulbs, tungsten light bulbs, fluorescent light bulbs, and so forth. It is mentioned that the lighting system may be used on a skateboard.

U.S. Pat. No. 7,220,011, issued May 22, 2007 to Hurwitz, relates safety and sports equipment including a skateboard, as well as apparel and accessories, including one or more wire-like or flat electroluminescent lamps for illumination. The lamps may be powered by battery, solar energy, or any other suitable means of energy. The lamps may further be secured to an object, embedded within a rigid surface, or recessed within a material. The lamps may be either permanently, temporarily, or removably secured to the object that is being illuminated.

U.S. Pat. No. 7,048,284, issued May 23, 2006 to Seifert, concerns an illuminated skateboard including a light string, configured to produce light, mounted about a peripheral edge of a deck. The peripheral edge of the deck extends between a top surface and a bottom surface of the deck. The illuminated skateboard also includes a pair of trucks each having a pair of wheels for supporting the deck, and a driver circuit coupled between an electrical power source and the light string. The driver circuit provides electrical power from the electrical power source to the light string. A method for making the illuminated skateboard is also described. The light string comprises an electroluminescent strip or a plurality of light-emitting diodes.

U.S. Pat. No. 5,513,080, issued Apr. 30, 1996 to Magle, shows a lighting kit that provides indirect lighting for roller skates or skateboards by mounting a lighting assembly under the shoe section of the skate or underside of the skateboard and providing a light directed down from the bottom of the shoe section of the skate or underside of the skateboard to the floor under the user. The color of the lighting system can be altered by placing a color filter in front of the lamp. In an alternative embodiment the conventional lamps used in the first embodiment are replaced by electroluminescent (EL) lamps. The EL lamps provide a flat structure which is relatively unnoticeable to observers when the skate is in use and the lamps turned off because they are positioned flat against the bottom of the skate or skateboard. When the lamps are activated, they illuminate the floor beneath the skate but are not directly seen. The third embodiment provides flat EL lamp panels which removably attach to the sides of the skates or skateboards such that they can be used not only for aesthetic reasons but also to provide an effective safety measure. The kit can be manufactured with the skate or skateboard as an integral component. In kit form, the electroluminescent lamps can be attached to existing in-line skates or skateboards via conventional attachment means such as adhesive or double stick tape. By using removable attachment means, such as double stick tape, hook and loop material, or the like, electroluminescent lamps of one color can be replaced with electroluminescent lamps of another color, thereby allowing a user to conveniently change the color of the light projected onto the floor beneath the in-line skate or skateboard.

U.S. Pat. No. 5,921,653, Jul. 13, 1999 to Chien, shows super-thin lighting arrangement for a moving object. An illumination arrangement for a small moving object of the type which includes a main object arranged to be moved when an outside force is applied to the object and a moving base arranged to permit the main object to move when the outside force is applied to the main object by overcoming a resistance to movement of the main object which would otherwise be present, includes an illumination arrangement mounted between the moving base and the main object. The moving object can for example take the form of a skate, skate board, or a toy such as a toy car. In the case of a skate, the illumination arrangement is mounted in a transparent outsole which also contains a power supply and all necessary circuitry, the lighting elements used therein being in the form of electroluminescent strips or panels, and the outsole being secured between the roller or blade mounting bracket of the skate and the boot by including openings for passage of the rivets or similar fasteners used to attach the mounting bracket to the boot. The boot itself may contain openings, such as ventilation openings, through which additional illumination elements attached to a soft liner can be viewed, or the object may itself be transparent and the illumination elements affixed to an inside surface of the main object.

U.S. Pat. No. 6,431,733, issued Aug. 13, 2002 to Seifert, relates an illuminated sports board which has a riding platform having a top surface and a bottom surface, a microcontroller mounted on the top surface, a power source operably connected to the microcontroller, an electro-luminescent sheet positioned on the riding platform, an electrical circuit electrically connecting the microcontroller to the electro-luminescent sheet, and a translucent resin layer covering both the riding platform and the electro-luminescent sheet.

Two U.S. Pat. No. 7,186,003 issued Mar. 6, 2007 and U.S. Pat. No. 7,064,498 issued Jun. 20, 2006 to Dowling, are for light-emitting diode based products. High-brightness LEDs are provided, which combined with a processor for control, can produce a variety of pleasing effects for display and illumination. A system is disclosed which uses high-brightness, processor-controlled LEDs in combination with diffuse materials to produce color-changing effects. The systems described may be usefully employed to bring autonomous color-changing ability and effects to a variety of consumer products and other household items. The system may also include sensors so that the illumination of the LEDs might change in response to environmental conditions or a user input. Additionally, the system may include an interface to a network, so that the illumination of the LEDs may be controlled via the network. The LED system may be adapted to a variety of lighting applications, either as a replacement for conventional light bulbs, including incandescent light bulbs, halogen light bulbs, tungsten light bulbs, fluorescent light bulbs, and so forth. It is mentioned that the lighting system may be used on a skateboard.

Two U.S. Pat. No. 7,161,313 issued Jan. 9, 2007 and U.S. Pat. No. 6,965,205 issued Nov. 15, 2005 to Piepgras, provide light emitting diode based products. Various exemplary implementations of light emitting diode (LED) based illumination products and methods are disclosed including, but not limited to, glow sticks, key chains, toys, balls, various game accessories, light bulbs, night lights, wall lights, wall switches, wall sockets, wall panels, modular lights, flexible lights, automotive lights, wearable accessories, light ropes, decorative lights such as icicles and icicle strings, light tubes, insect control lights and methods, and lighted air fresheners/scent dispensers. Any of the foregoing devices may be equipped with various types of user interfaces (both "local" and "remote") to control light generated from the device. Additionally, devices may be controlled via light control information or programs stored in device memory and/or transmitted or downloaded to the devices (e.g., devices may be controlled individually or collectively in groups via a network, glow sticks or other products may be downloaded with programming information that is stored in memory, etc.). Devices also may include sensors so that the generated light may change in response to various operating and/or environmental conditions or a user input. Various optical processing devices which may be used with any of the devices (e.g., reflectors, diffusers, etc.) also are disclosed. The LED system may be adapted to a variety of lighting applications, either as a replacement for conventional light bulbs, including incandescent light bulbs, halogen light bulbs, tungsten light bulbs, fluorescent light bulbs, and so forth. It is mentioned that the lighting system may be used on a skateboard.

U.S. Pat. No. 5,765,936, issued Jun. 16, 1998 to Walton, is for a portable neon lighting system connectable to a vehicle. The portable neon lighting system comprises a first plastic encased neon light which comprises a first plastic encased neon light electrical connection, at least one first plastic encased neon light first strap, and at least one first plastic encased neon light second strap. The portable neon lighting system further comprises a rechargeable battery/transformer electrically connected to the first plastic encased neon light electrical connection. The rechargeable battery/transformer comprises a rechargeable battery/transformer ON/OFF switch electrically connected between the battery and the transformer, the rechargeable battery/transformer is connectable to a frame member by a rechargeable battery/transformer first strap and a rechargeable battery/transformer second strap. The portable neon lighting system further comprises a recharger electrically connected to the rechargeable battery/transformer by a recharger electrical connection. The recharger is connectable to a frame member by a recharger first strap and a recharger second strap. The recharger further comprises a recharger engager which functions to engage to and rotate with a moving part of the vehicle. The recharger engager functions as an energy transformation means to power the rechargeable battery/transformer thereby generating electricity therefrom.

What is needed is a high strength secured and protected light source removably attachable to a skateboard with a variety of lighting options to enhance the visual effects of the lighted skateboard in action.

BRIEF SUMMARY OF THE INVENTION

An object of the present invention is to provide a multiple tube, multiple lights effects neon or fluorescent lighting system with a variety of controlled light effects and combinations encased in a pair of high strength colored protective transparent elongated casings removable attached in a highly visible position on the side edges of a skateboard or under the skateboard adjacent to the side edges by high strength secured and protected light source removably attachable to a skateboard with a battery source and controls for a variety of lighting options to enhance the visual effects of the lighted skateboard in action.

In brief, the present invention comprises two tubular lights, ¼ inches in diameter, which are attached to the skate board. The two lights are preferably 7½ inches to 12 inches in length. The lights can be turned on to run the length of the tube, back and forth, flash, or remain steadily on. The lights will come in various colors of blue, red, green, or yellow. The tubular lights run on four AG13 batteries and have an off and on button. The lights are attached to the skate board by Industrial Strength Velcro strips with monofilament thread and thick polyurethane backing which run 4-6 inches in length and can be attached to either the sides of the skateboard or underneath the skateboard. The strips are approximately ½ inch wide in order to fit on the sides of the skateboard. The lights can be easily installed or removed. The present invention has a colored outside protective plastic tube and inside neon or fluorescent tubes.

An advantage of the present invention is that it provides a pair of high strength secured and protected light sources removably attachable to a skateboard in highly visible locations with a battery source and controls for a variety of lighting options to enhance the visual effects of the lighted skateboard in action.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
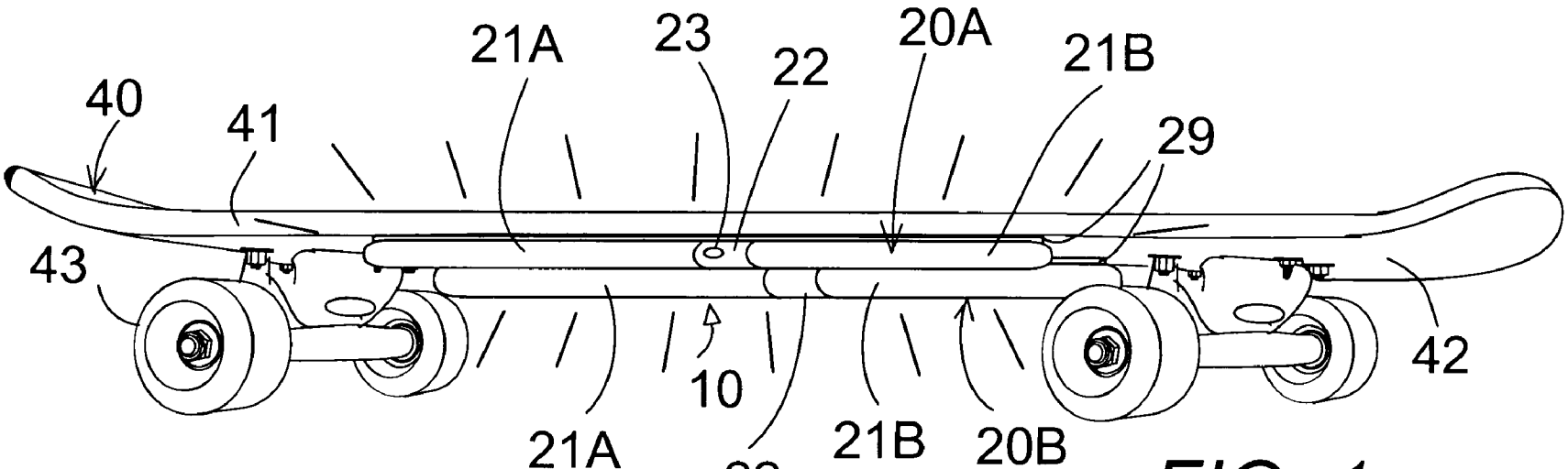
FIG. 1 is a perspective view of the variable lighting system for skateboards of the present invention showing the two protective casings with variable light tubes attached under the skateboard adjacent to the edges of the skateboard.
Figure 2:
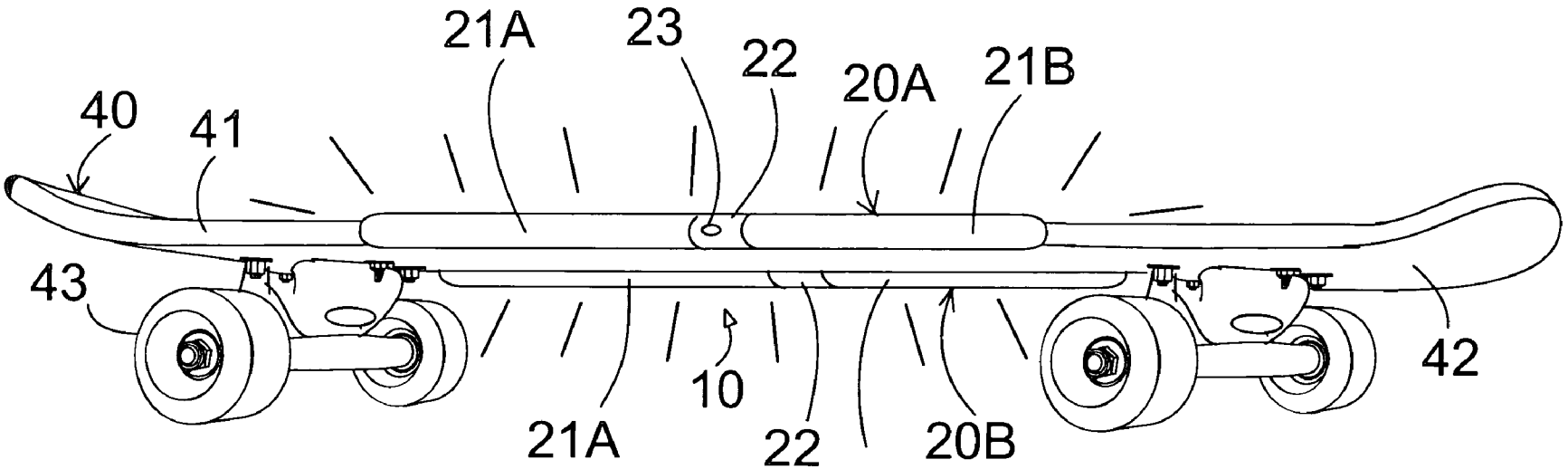
FIG. 2 is a perspective view of the variable lighting system for skateboards of the present invention showing the two protective casings with variable light tubes attached to the edges of the skateboard.
Figure 3:
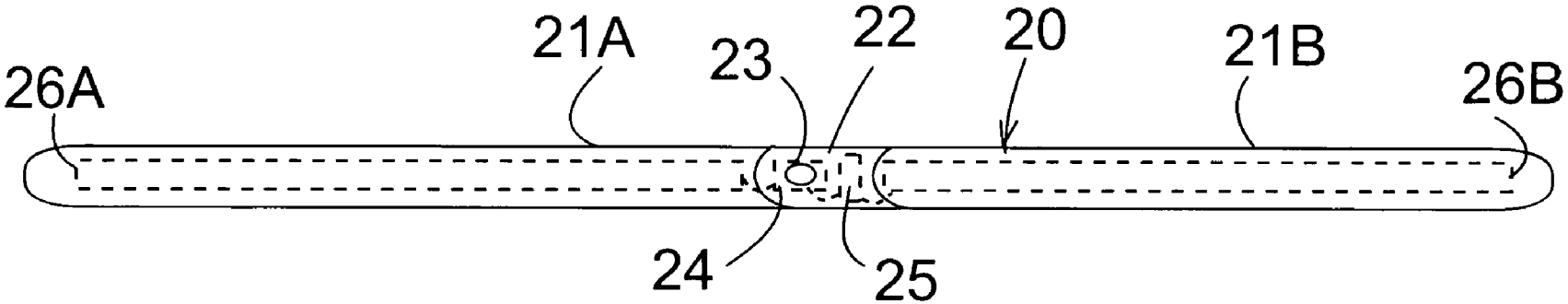
FIG. 3 is an elevational view of one of the protective light casings of the present invention showing the interior light emitting tubes, variable control, and power source.

In FIGS. 1-3, a variable lighting system 10 for skateboards comprises at least two light emitting tubes 26A and 26B in each of at least two protective casings 20A and 20B is removably secured on the sides of a skateboard 40 by high strength connectors such as industrial strength hook and loop fasteners 29.

The elongated light admissive casings 20 are fabricated of shock resistant and break resistant synthetic material allowing light to pass through the material. Each of the casings 20 may comprise a colored transparent or translucent cylinder which is preferably fabricated of a structurally break resistant material such as a high strength nylon cylinder.

The protective casings 20A and 20B are attached to the skateboard by at least one pair of industrial strength mating hook and loop fasteners 29 attached between each of the casings and the skateboard for removably mounting the casings in a visible location in the vicinity of an outer perimeter of the skateboard with at least one of the casings on each of at least two sides of the skateboard, the industrial strength mating hook and loop mating fasteners extending over a length and width of a side of each of the casings positioned between each of the casings and the skateboard to insure that the casings will not be knocked off of the skateboard, the industrial strength mating hook and loop fasteners not readily visible behind each of the casings.

In FIG. 1, the two protective light casings 20A and 20B are mounted with one on each of two side edges 41 of the skateboard 40.

In FIG. 2, the two protective light casings 20A and 20B are mounted underneath the skateboard on the bottom surface 42 of the skateboard on each of two sides of the skateboard immediately adjacent to the side edge 41 of the skateboard 40.

In FIG. 3, the light source comprises at least two light emitting tubes 26A and 26B housed within each of the casings 20A and 20B spaced apart along the length of the casings to enable a variety of lighting effects. The light emitting tubes preferably comprise colored neon light tubes or colored fluorescent light tubes.

A power source 25 for the light emitting tubes is housed within each of the casings 20A and 20B, comprising a battery source positioned in a section 22 of each of the casings adjacent to the light emitting tubes 26A and 26B and the at least one means for controlling the at least two light emitting tubes in each of the casings comprises at least one manual control device 23 communicating between the power source and the light emitting tubes, preferably the control device being at least one control button 23 on the exterior of the casing with an interior control circuit 24 for controlling variable lighting effects in the light emitting tubes including at least one of the lighting effects taken from the list of lighting effects comprising individual steady light, multiple simultaneous stead lights, individual flashing light, simultaneous coordinated flashing lights, alternating flashing lights, sequential flashing lights, reverse flashing lights, one directional flashing lights, multiple directional flashing lights.

The two protective casings 20A and 20B are preferably ¼ inches in diameter and the two tubular lights 26A and 26B are preferably 7½ inches to 12 inches in length. The lights will come in various colors of blue, red, green, yellow, or other desired colors. The tubular lights run on four AG13 batteries and have an off and on button with controls for the various light effects. The lights are attached to the skate board by Industrial Strength Velcro strips with monofilament thread and thick polyurethane backing which run 4-6 inches in length and can be attached to either the sides of the skateboard or underneath the skateboard. The strips are approximately ½ inch wide in order to fit on the sides of the skateboard. The lights can be easily installed or removed. The present invention preferably has a colored outside protective plastic tube and inside neon or fluorescent tubes.

In use, the protective casings 20A and 20B are removably attached as desired to the edges or bottom of the skateboard adjacent to the edges. The control button or other control device is activated for the desired lighting effect and the user rides the skateboard as desired with the lighting effects highly visible.

It is understood that the preceding description is given merely by way of illustration and not in limitation of the invention and that various modifications may be made thereto without departing from the spirit of the invention as claimed.

What is claimed is:

1. A variable lighting system in protective casings removably secured at the edges of a skateboard by high strength removable connectors, the system comprising:

at least one pair of elongated light admissive casings fabricated of shock resistant and break resistant synthetic material allowing light to pass through the material while resisting damage from skateboard activity, the at least one pair of elongated light admissive casings mounted adjacent to an edge of a skateboard below the top surface of the skateboard to be visible to others in the vicinity of the skateboard while not interfering with the feet of a user on the skateboard;

at least two light emitting tubes housed within each of the casings spaced apart along the length of the casings;

a self contained battery power source for the light emitting tubes housed within each of the casings, so that the power source is removable with the casings;

at least one means for controlling the at least two light emitting tubes in each of the casings operable from an exterior of the casings, the at least one means for controlling producing variable lighting effects in the light emitting tubes including at least one of the lighting effects taken from the list of lighting effects comprising individual steady light, multiple simultaneous stead lights, individual Hashing light, simultaneous coordinated flashing lights, alternating flashing lights, sequential flashing lights, reverse flashing lights, one directional flashing lights, multiple directional flashing lights thereby providing a variety of lighting options and variable lighting effects to enhance the visual effects of the lighted skateboard in action;

at least one pair of industrial strength mating hook and loop fasteners attached between each of the casings and the skateboard for removably mounting the casings in a visible location in the vicinity of an outer perimeter of the skateboard with at least one of the casings on each of at least two sides of the skateboard, the industrial strength mating hook and loop mating fasteners extending over a length and width of a side of each of the casings positioned between each of the casings and the skateboard so that the casings will not be knocked off of the skateboard during skateboard activity and so that the casings are removable by a user without the need for tools to enable high impact edge riding on the skateboard without the casings when desired, and replaceable by the user without the need for tools for producing the variable lighting effects when desired, the industrial strength mating hook and loop fasteners not readily visible behind each of the casings, thereby providing a variable lighting system in protective casings removably secured at the edges of a skateboard by high strength removable connectors.

2. The system of claim 1 wherein the at least two light emitting tubes comprise colored neon light tubes.

3. The system of claim 1 wherein the at least two light emitting tubes comprise colored fluorescent light tubes.

4. The system of claim 1 wherein the power source comprises a battery source positioned in a section of each of the casings adjacent to the light emitting tubes and the at least one means for controlling the at least two light emitting tubes in each of the casings comprises at least one manual control device communicating between the power source and the light emitting tubes.

5. The system of claim 1 wherein each of the casings comprises a colored transparent cylinder.

6. The system of claim 1 wherein each of the casings comprises a colored translucent cylinder.

7. The system of claim 1 wherein each of the casings comprises a high strength nylon cylinder.

8. The system of claim 1 wherein one of the casings is mounted on each of two side edges of the skateboard.

9. The system of claim 1 wherein one of the casings is mounted underneath the skateboard on each of two sides of the skateboard immediately adjacent to the side edge of the skateboard,

* * * * *